United States Patent [19]

Kimura et al.

[11] Patent Number: 4,811,525

[45] Date of Patent: Mar. 14, 1989

[54] GRINDING HEAD FOR A GRINDING MACHINE

[75] Inventors: Soosaku Kimura; Masaya Itoh; Takeshi Okabe, all of Tokorozawa, Japan

[73] Assignee: Citizen Watch Co., Ltd., Tokyo, Japan

[21] Appl. No.: 159,960

[22] Filed: Feb. 24, 1988

[51] Int. Cl.[4] ..... B24B 41/00

[52] U.S. Cl. ..... 51/166 MH

[58] Field of Search ..... 51/166 R, 166 MH, 166 TS, 51/168

[56] References Cited

U.S. PATENT DOCUMENTS

| | | | |
|---|---|---|---|
| 2,457,468 | 12/1948 | Hercik | 51/166 MH |
| 3,247,621 | 4/1966 | Aller | 51/168 |
| 3,673,743 | 7/1972 | Giardini et al. | 51/168 |
| 3,736,705 | 6/1973 | Ryan et al. | 51/168 |

*Primary Examiner*—Roscoe V. Parker

*Attorney, Agent, or Firm*—Birch, Stewart, Kolasch & Birch

[57] ABSTRACT

A supporting member is vertically slidably mounted on a grinding head body which is vertically slidably mounted on a cross rail of a grinding machine. A jaw is provided on the supporting member at an end thereof. A grinding-wheel spindle assembly includes a center shaft one end of which is secured to the grinding head body and the other end is supported between the jaw and an end of the supporting member, and a sleeve rotatably mounted on the center shaft. A grinding wheel is secured to the sleeve. In order to permit replacement of the grinding wheel, the jaw is opened and the supporting member is retracted from an operating position where the center shaft is supported by the jaw to a retracted position apart from the center shaft.

11 Claims, 11 Drawing Sheets

GRINDING HEAD FOR A GRINDING MACHINE

BACKGROUND OF THE INVENTION

The present invention relates to a grinder for grinding process, and more particularly to structure for a grinding head for a surface grinder for super-precision grinding process.

There are three types of surface grinders. In a first type, a column secured to a bed is provided for supporting a grinding head having a grinding-wheel spindle and guiding along a vertical path. A table to which a workpiece is secured is moved in a cross direction and a longitudinal direction. In a second type, a column is provided on a cross slide which is moved in a cross direction. The column has a grinding head which is moved in a vertical direction. A table is moved in a longitudinal direction only. A third type is a portal type surface grinder, in which a cross rail is mounted on a portal column and provided to be moved in the vertical direction. A grinding head is provided on the cross rail to be moved in a cross direction. A table is moved in a longitudinal direction.

In the first and second types, since the workpiece on the table is fed passing through a space under the grinding head in the cross direction, or the grinding head moves in the cross direction, a grinding wheel must be located at a position largely apart from the column by a width of the table in cross direction. Therefore, a grinding-wheel spindle has a cantilevered structure projected from a bearing portion. In the third type, the grinding wheel is mounted on an end of the grinding wheel spindle. Thus, the spindle also has the cantilevered structure. The cantilevered structure is inherently inferior in stiffness. In order to improve the accuracy of grinding process, even if stiffness of bearing elements for the grinding wheel spindle is increased, the accuracy cannot be sufficiently improved, because of deflection of the cantilevered spindle. To avoid such a deflection, stiffness of the spindle must be increased. The stiffness of the spindle can be increased by enlarging the diameter. However, the diameter of the spindle cannot be largely increased, since the large diameter portion interferes with the work. Therefore, the increase of the stiffness of the spindle is limited.

In addition, thermal displacement of elements of the grinding machine is increased at the grinding process position, because of the cantilevered structure. Accordingly, high accurate grinding process cannot be expected in conventional grinders.

SUMMARY OF THE INVENTION

An object of the present invention is to provide a grinding head for a surface grinder which has a sufficient stiffness and may reduce the influence of thermal deformation of the machine, thereby increasing the process accuracy.

Another object of the present invention is to provide a feeding device which may feed a table along a true straight line and stop the table at a desired position with high accuracy.

According to the present invention, there is provided a grinding head for a grinding machine comprising, a grinding head body, a support member movably mounted on the grinding head body, a jaw provided on the supporting member at an end portion thereof, a grinding-wheel spindle assembly including a center shaft one end of which is secured to the grinding head body and the other end is supported by the jaw, a sleeve rotatably mounted on the center shaft through hydrostatic bearings, and a grinding wheel secured to the sleeve.

A hydraulic cylinder is provided for moving the supporting member between an operating position where the center shaft is supported by the jaw and a retracted position apart from the center shaft. The jaw is opened by the hydraulic cylinder.

Further, a stopper is provided for positioning the supporting member at the operating position, and a position sensing device is provided for detecting the position of the supporting member at the operating position.

These and other objects and features of the present invention will become more apparent from the following description with reference to the accompanying drawings.

DETAILED DESCRIPTION OF THE PREFERRED EMBODIMENT

Figure 1:
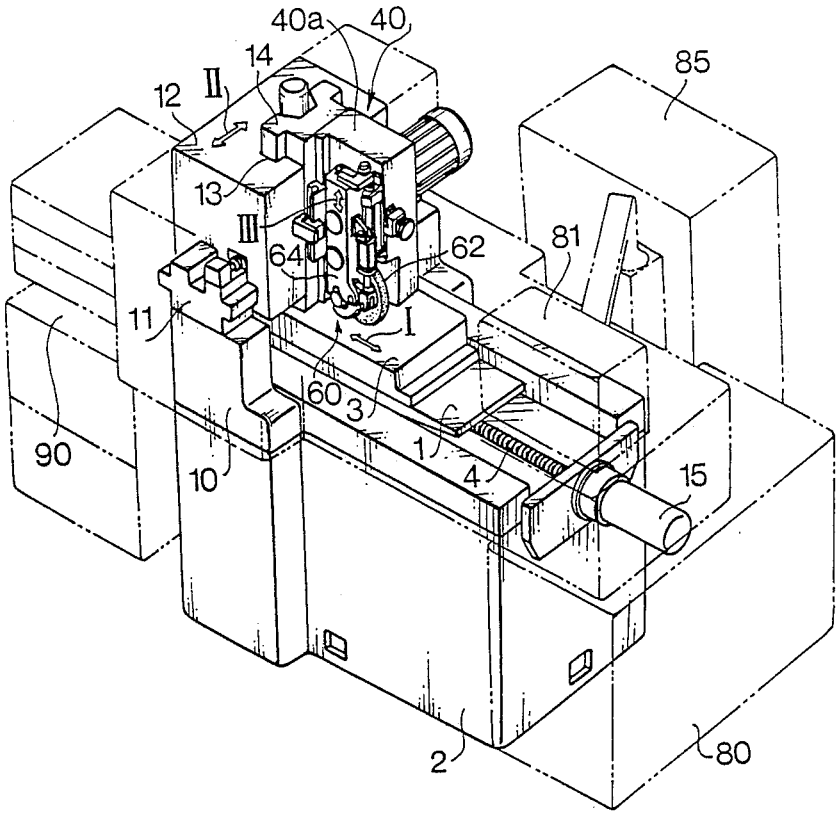
FIG. 1 is a perspective view of a surface grinder provided with a grinding head according to the present invention.
Figure 2:
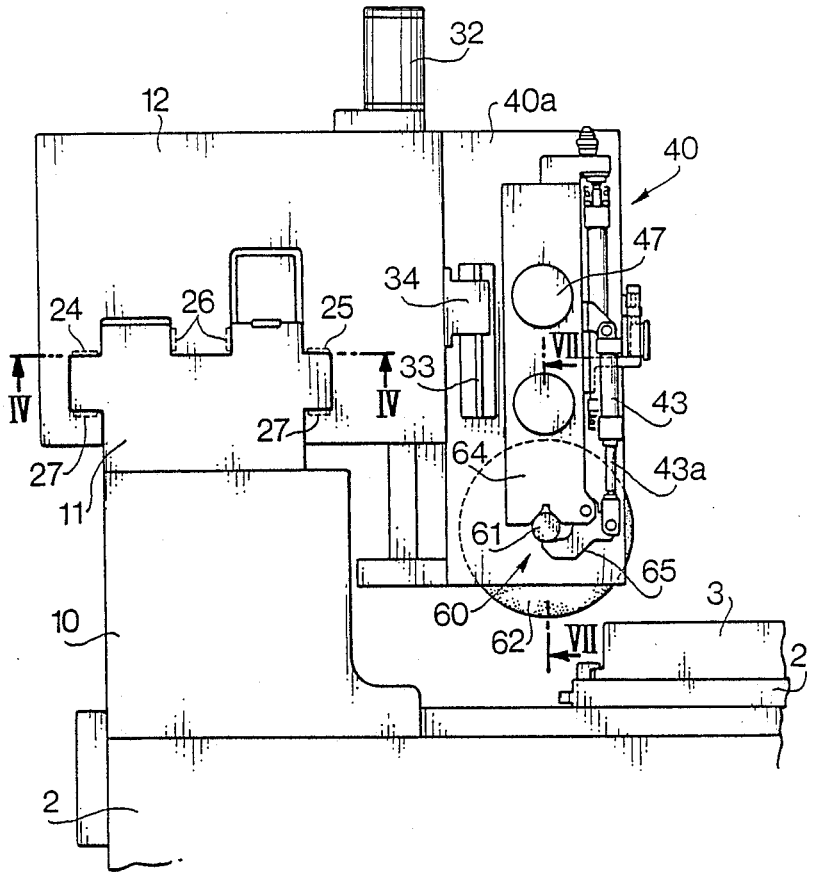
FIG. 2 is an enlarged front view of a main part of the grinder.
Figure 3:
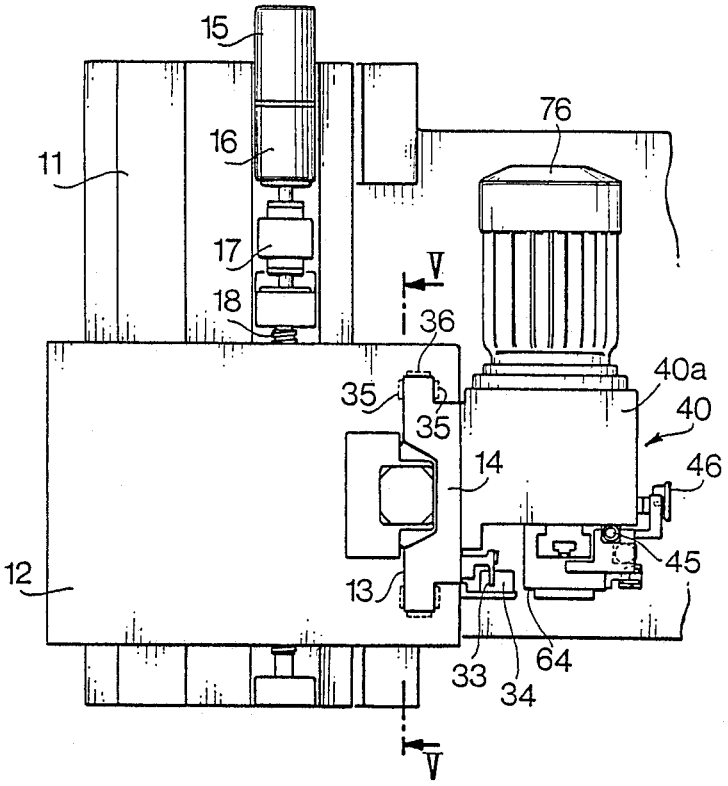
FIG. 3 is a plan view of the part shown in FIG. 2.

Referring to FIGS. 1 to 3 showing a surface grinder having a grinding head of the present invention, a work table 1 is a slidably mounted on a bed 2 so as to be reciprocated in the longitudinal direction of the bed 2. A magnetic chuck 3 is secured to the work table 1. A portal column 10 is securely mounted on the bed 2, laterally crossing over the work table 1 at an end thereof. Secured to an upper portion of the column 10 is a cross rail 11 on which a cross slide 12 is slidably engaged so as to be reciprocated along the cross rail 11. Formed on one side of cross slide 12 is a T-shaped vertical guide way 12 with which a vertical slide 14 is slidably engaged. A grinding head body 40*a* of a grinding head 40 is secured to the vertical slide 14. As it will be described hereinafter in detail, a grinding-wheel spindle assembly 60 of the present invention is mounted on the front side of the grinding wheel head body 40*a*.

Referring to FIG. 1, a controller 80 and an operating box 81 are provided for controlling and operating servomotors for moving the work table 1 in the longitudinal direction I, the cross slide 12 in the cross direction II, and the vertical slide 14 in the vertical direction III, respectively.

In the surface grinder, rotating shafts, screws and slides are supported by hydro-static bearings. An oil pressure supply unit 85 is provided for supplying pressurized oil to hydro-static bearings. The oil pressure supply unit 85 includes a high accuracy temperature control system comprising an oil temperature controller of an ON-OFF type, and a damping tank for damping a temperature ripple.

A coolant apparatus 90 is provided for supplying a coolant to the grinding process position for controlling the temperature. The coolant apparatus also includes a high accuracy temperature control system.

As shown in FIG. 3, a motor 15 mounted on the cross rail 11 is provided for driving the cross slide 12. The motor 15 is connected to a hydro-static lead screw 18 through a reduction device 16 and a flexible coupling 17. The lead screw 18 engages with a hydrostatic nut 19 (FIG. 6) which is secured to the cross slide 12.

Figure 6:
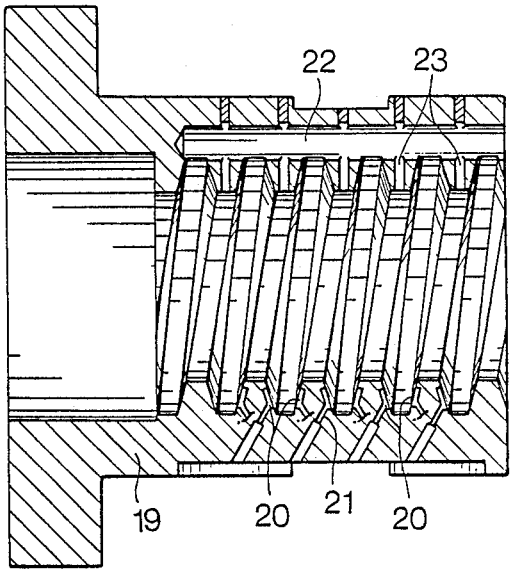
FIG. 6 is a sectional view of a female screw mounted on a cross slide.

Referring to FIG. 6, the hydro-static nut 19 has hydro-static recess 20 formed on an internal thread at four positions per one pitch at regular angular intervals. A port 21 as a pressure restrictor is provided for supplying the pressurized oil from the oil pressure supply unit 85 to each hydro-static recess 20. Accordingly, the lead screw 18 engages with the hydrostatic nut 19 through a thin oil film there-between. In order to drain the oil, hydro-static nut 19 has a drain passage 22 formed in a bottom of the thread in the axial direction, and drain ports 23 formed on minor diameter portions of the internal thread thereof and communicated with the drain passage 22. Since each drain port 23 is radially disposed, the port can be easily formed by a drill.

Figure 4:
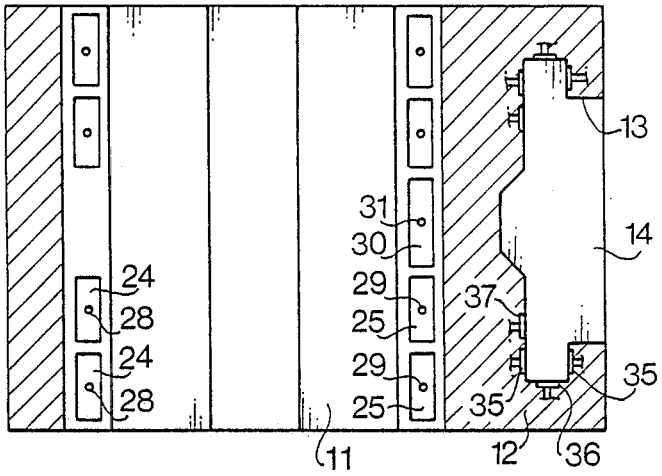
FIG. 4 is a sectional view taken along a line IV—IV of FIG. 2.

Referring to FIG. 2, the cross slide 12 slidably mounted on the cross rail 11 is restricted in transverse and vertical movements by hydro-static bearings 24, 25, 26 and 27. As shown in FIG. 4, bearings 24 and 25 have restrictors 28 and 29, respectively, which reduce the pressure of oil from the oil pressure supply unit 85 and supply the oil to the bearings. Similarly, bearings 26 and 27 have restrictors (not shown). Thus, the cross slide 12 is engaged with the cross rail 11 through thin oil films formed there-between.

As shown in FIG. 2, deviated loads of the cross slide 12 and grinding head 40 are exerted on bearings 24, 25 and 27. Accordingly, oil pressure supplied to the bearings is adjusted so as to bear the deviated loads. Further, a hydro-static bearing 30 having a port 31 is provided adjacent the bearings 25 as shown in FIG. 4 in order to cancel the unbalanced loads.

The static pressure of bearings 24 to 27 is reduced to ½ or ⅔ of the supply pressure from the unit 85, in consideration of stiffness of bearing portions. However, the bearing 30 as a balancer is not provided with a pressure reducing valve in order to cancel the unbalance of loads. Further, the system is provided such that the static pressure at the bearing 30 can be independently adjusted. Accordingly, even if the supply pressure is increased, thermal or mechanical deformation can be prevented.

Pressure sensors for the bearings 24 to 27 or displacement sensors can be used for sensing deformations of the cross slide 12 or the grinding head 40 by outer force during grinding operations. The supply pressure at the bearing 30 is adjusted by a converter such as an electro-hydraulic pressure servo valve in accordance with output signals of the sensors to prevent the deformation at quick response with high damping characteristic.

In the case, such a fluctuating dynamic load that cannot be controlled by the servo-system exerts on a grinding wheel 62, the supply pressure to the bearings 24 and 25 are stopped by a switching device (not shown), and pressure is applied to the bearings 27, so that the surfaces corresponding to bearings 24, 25 are pressed against the cross rail 11, thereby securing the cross slide 12 to the cross rail 11.

Since the cross slide 12 is supported by hydro-static bearings, the position of the slide is not affected from errors in measurements of the device. Accordingly, the slide can be moved along a true straight line. Further, since the nut 19 engages with the lead screw 18 through hydro-static bearings, the cross slide 12 can be stopped at a desired position with high accuracy without influence of measurement erros of screws.

The vertical slide 14 is operatively connected to a rotary shaft of a motor 32 (FIG. 2) through a reduction device, lead screw, and nut (not shown), so that the vertical slide 14 is reciprocated along guide way 13 in the vertical direction III (FIG. 1) by the motor. A position detector 34 is provided on the cross slide 12 for detecting the position of the vertical slide 14 in accordance with the graduation of a linear scale 33 which is provided on the vertical slide 14. The detector 34 produces an output signal which is fed to an amplifier (not shown) for amplifying the signal. The position of the vertical slide 14 can be sensed at unit of 0.1 μm, by dividing the amplified signal. In the present embodiment, the signal from the detector 34 is used as a feedback signal and the motor 32 acts as an actuator to compose a servo-mechanism.

Figure 5:
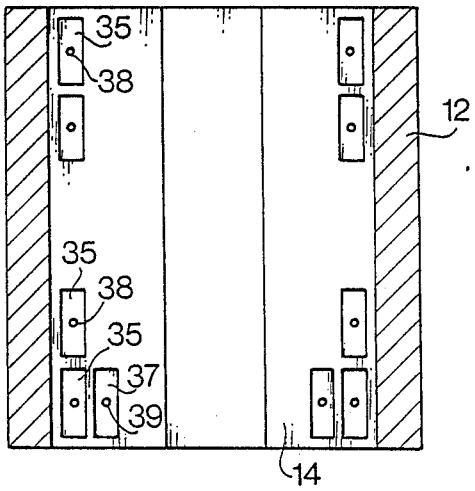
FIG. 5 is a sectional view taken along a line V—V of FIG. 3.

Referring to FIGS. 3, 4 and 5, hydro-static bearings 35, 36 for the vertical slide 14 are provided on the vertical guide way 13 of the cross slide 12. Further, a bearing 37 as a balancer is provided. The static pressure from the unit 85 are supplied to each of bearings 35, 36 through a restrictor 38 and to bearing 37 through a port 39. These bearings operate in the same manners as those of the cross slide 12.

Figure 7:
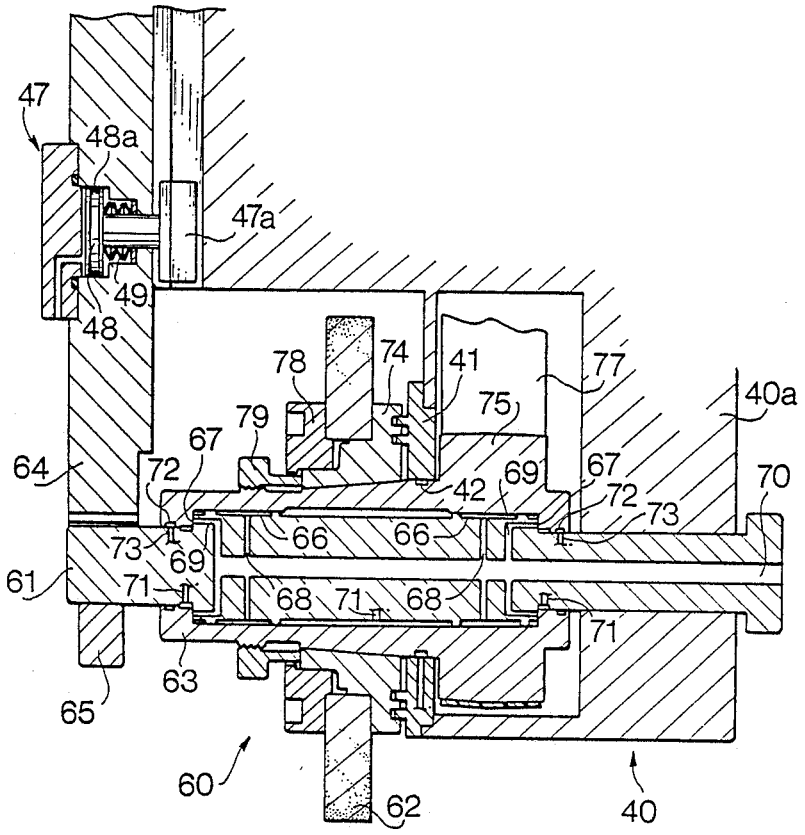
FIG. 7 is an enlarged sectional view taken along a line VII—VII of FIG. 2.
Figure 8:
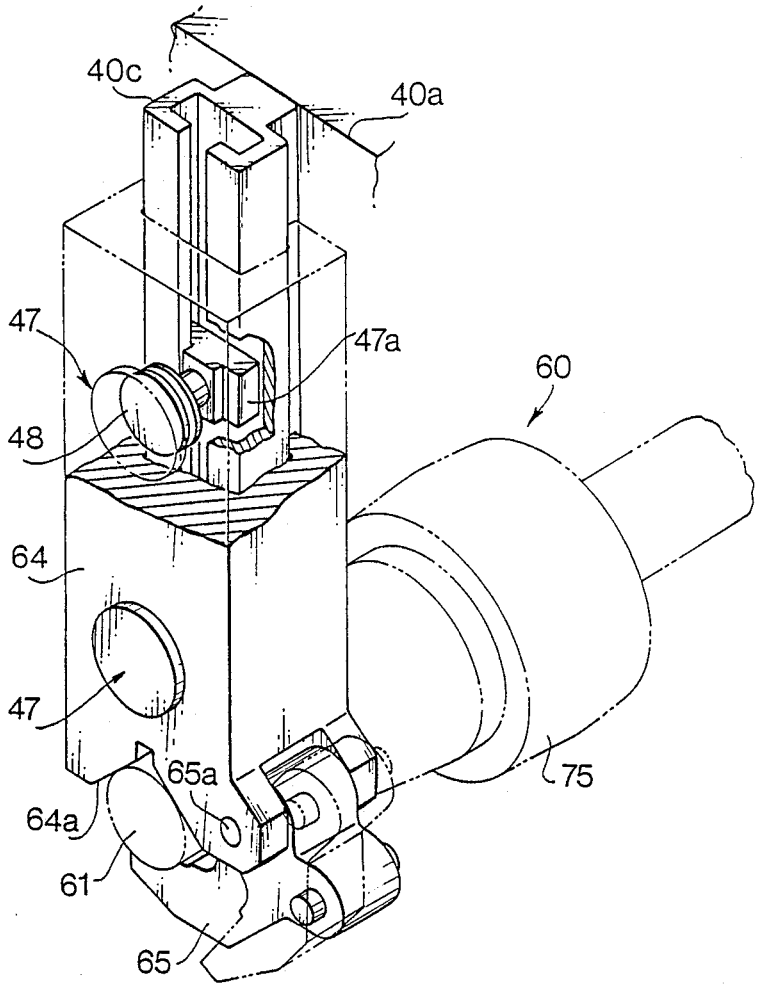
FIG. 8 is an enlarged perspective view showing a supporting member for a grinding-wheel spindle.

Referring to FIGS. 2, 7 and 8 showing the grinding-wheel spindle head, a supporting member 64 for supporting the grinding-wheel spindle assembly 60 is vertically and slidably mounted on the front side of guiding head body 40*a* of the grinding head 40, so as to slide along a guide projection 40*c*, and secured thereto by clamping devices 47.

Each clamping device 47 comprises a piston 48 in a cylinder 48*a*, a clamper 47*a* having a T-shaped section and secured to the end of the piston 48, and disk springs 49. The clamper 47a is slidably engaged with an inner wall of a T-shaped guide groove of projection 40*c* and pressed against the wall by the spring 49 to clamp the supporting member 64. The clamper 47*a* is released by supplying oil to the cylinder 48*a* to push the piston 48.

Figure 2A:
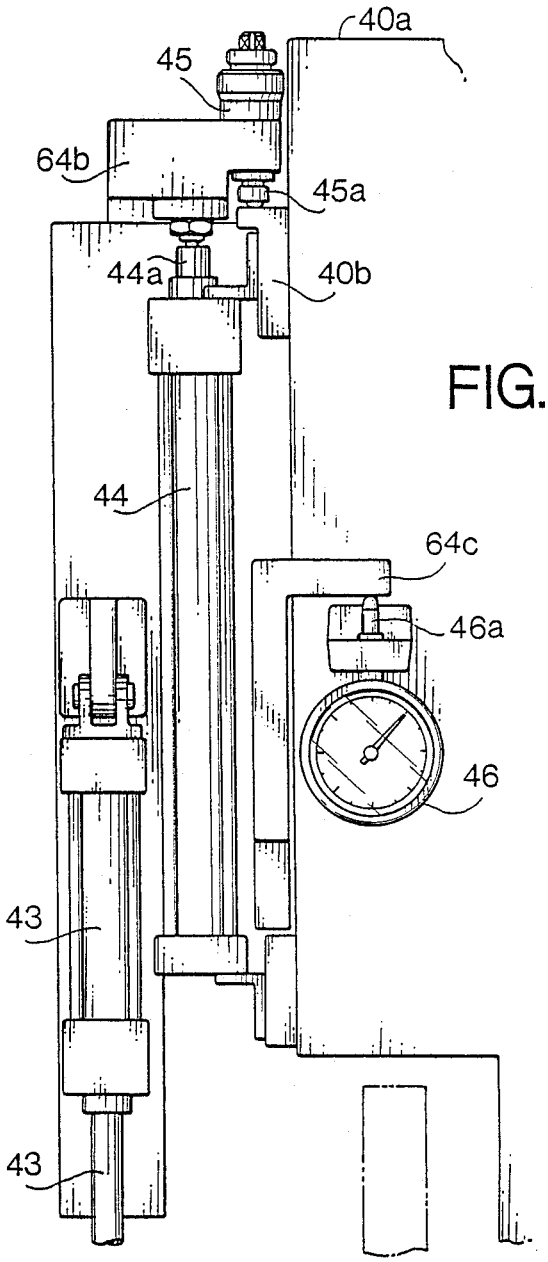
FIG. 2a is an enlarged side view as viewed from the right side of FIG. 2.

The supporting member 64 has a V-shaped groove 64*a* formed on a lower end thereof for receiving an end of a center shaft 61, and a jaw 65 pivotally mounted on a shaft 65*a* provided in a lower end portion of the supporting member so as to correspond to the groove 64*a*. As shown in FIGS. 2 and 2*a*, a piston rod 43*a* of a hydraulic cylinder 43 mounted on the supporting member 64 is connected to the jaw 65 at an end thereof for opening and closing the jaw. A top of a piston rod 44a of a hydraulic cylinder 44 mounted on the grinding head body 40a is engaged with an overhang member 64b projected from the supporting member 64. A stopper 45 having a micrometer mechanism is secured to the overhang member 64b and a stopper end 45a engages with a projection 40b of the grinding head body 40a for positioning the member 64 at a predetermined supporting position of the center shaft 61.

A position detector 46, such as a dial indicator, electric comparator or signal indicator, is provided on the grinding head body 40a. A spindle 46a engages with a projection 64c at the lower end position of the supporting member 64, for detecting the operating position of the center shaft 61.

When the detector 46 detects that the position of the supporting member 64 is deviated from the predetermined position, the position of the stopper 45 is corrected. In order to improve the accuracy of the positioning, a servo-system may be provided in which an electric comparator is used as detector 46 and the hydraulic cylinder 44 or the stopper 45 is used as an actuator. The servosystem starts to operate when the position member 64 produces an output signal representing the position of the center shaft 61. When the center shaft 61 (supporting member 64) deviates from the predetermined position, the servosystem operates to activate the hydraulic cylinder 44 or stopper 45 to reduce the deviation within an allowable range. Since the positioning operation is performed after the detector of the deviation, a measuring device having a high resolution can be used, thereby positioning the center shaft 61 with high accuracy.

As shown in FIG. 7, the grinding wheel spindle assembly 60 comprises center shaft 61, and a sleeve 63, as a grinding wheel spindle, rotatably mounted on the center shaft. An end of the center shaft 61 is securely mounted in the grinding head body 40a and the other end is detachably mounted on the supporting member 64 by the jaw 65. The center shaft 61 has an axial oil passage 70, restrictors 68, 69 communicated with the passage 70, radial hydro-static bearings 66 communicated with restrictors 68, and axial hydro-static bearings 67 communicated with restrictors 69. Further, drain ports 71 and air supply passages 73 for air seals 72 are provided. Pressurized oil is supplied to the hydro-static bearings 66, 67 from the passage 70 through restrictors 68 and 69.

The sleeve 63 is provided with a pulley 75 connected to a pulley (not shown) of a spindle driving motor 76 (FIG. 3) through a belt 77. A flange 74 is fixed to a taper surface of the sleeve 63 by means of a nut 79. The grinding wheel 62 is secured to the flange 74 by means of a nut 78 in the same as a usual manner. A fixed ring 41 which is secured to the head body 40a is disposed between the pulley 75 and the flange 74. A labyrinth and air seal 42 is disposed between the ring 41 and the flange 74, so that sticking of the coolant to pulley 75 and belt 77 is prevented.

In order to remove the grinding wheel 62, the jaw 65 is opened, the supporting member 64 at the lower operating position is raised by the hydraulic cylinder 44. Thus, the grinding wheel 62 can be easily detached from the center shaft 61.

Figure 9:
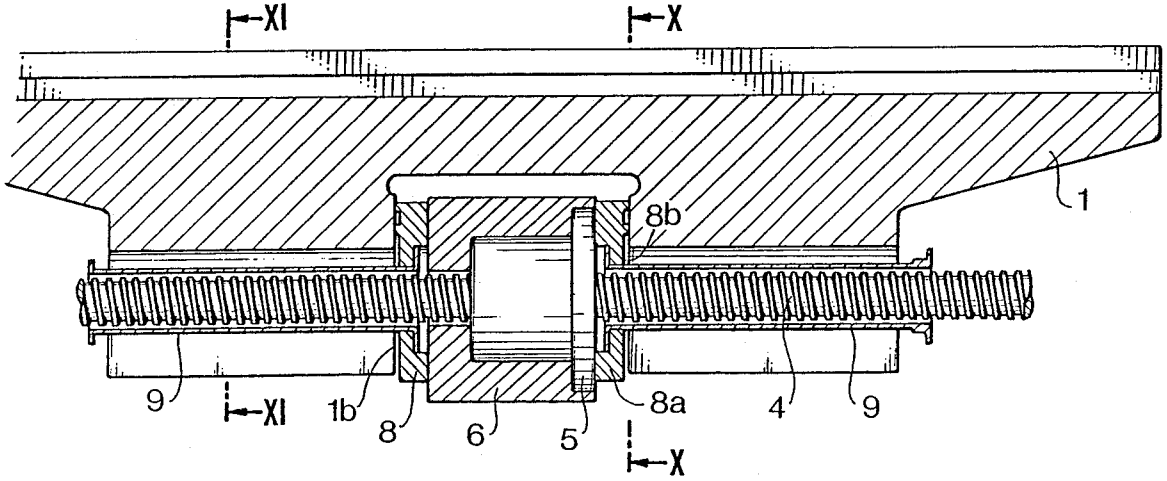
FIG. 9 is a sectional view of a work table of the surface grinder.
Figure 10:
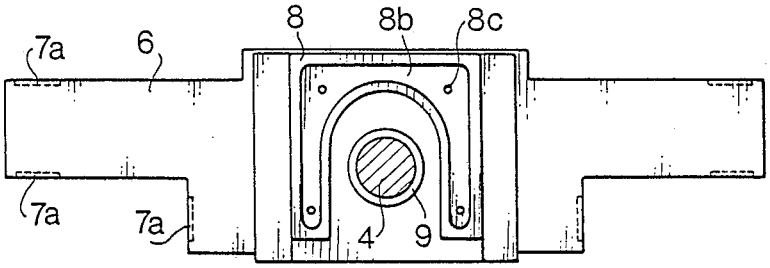
FIG. 10 is a sectional view taken along a line X—X of FIG. 9.
Figure 11:
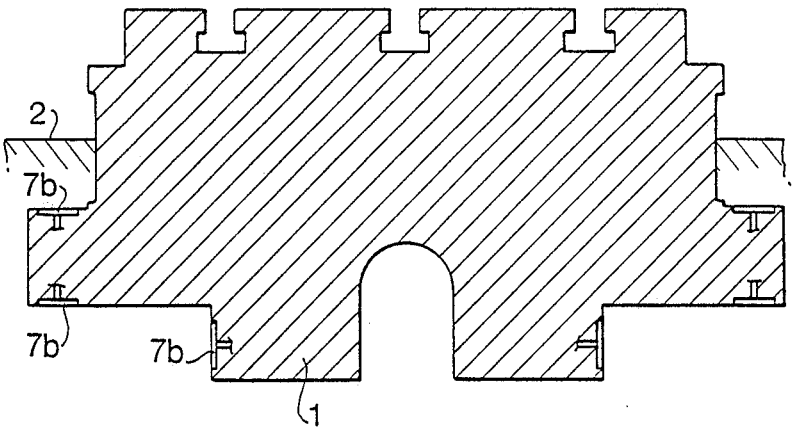
FIG. 11 is a sectional view taken along a line XI—XI of FIG. 9.

FIGS. 9 to 11 show the structure of the work table 1. The work table 1 has a lateral groove 1b underside thereof, in which a feeding table 6 is mounted, interposing opposite collars 8, 8a there-between. A hydrostatic nut 5 engaged with a lead screw 4 is mounted in the feeding table 6 and secured to the table 6 by the collar 8a. The nut 5 has hydro-static bearings like the nut 19. The work table 1 is supported on guide surfaces of the bed 2 by hydro-static bearings 7b in the vertical and lateral directions as shown in FIG. 11. The feeding table 6 is also supported on the bed 2 by hydro-static bearings 7a on the same guide surfaces as the work table 1. Each of collars 8, 8a has a hydrostatic bearing 8b having a restrictor 8c for supplying pressurized oil. A pair of cover tubes 9 are provided around the lead screw 4 for preventing the oil from flowing out on the lead screw 4 to melt the grease thereon. Since the work table 1 is positioned through the hydrostatic bearings 8b, the work table can be accurately located by adjusting the pressure in each bearing, without influence of dimensional errors in threads of screw 4 and nut 5.

Figure 12:
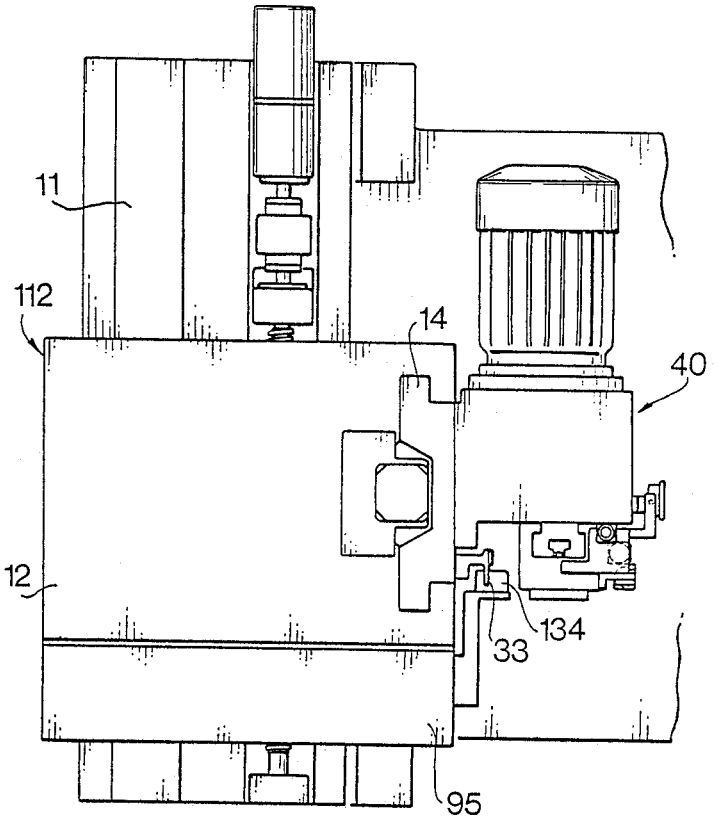
FIG. 12 is a plan view showing another embodiment of the present invention.

FIG. 12 shows another embodiment of the present invention. A cross slide 112 consists of the cross slide 12 having the same structure as the first embodiment and a scond cross slide 95. The second cross slide 95 is slidably engaged with the cross rail 11 and supported by hydro-static bearings on the same guide surfaces as the cross slide 12. The cross slide 12 and the second cross slide 95 are coupled with each other only in the feeding direction. A position detector 134 for the linear scale 33 is mounted on the second cross slide 95. Thus, even if the position of the cross slide 12 is deviated by outer force, the second cross slide 95 is not affected, and hence the position of the detector 134 is unchanged. Accordingly, the detector 134 can detect the position of the cross slide 12 including the deviation of the posture thereof. In addition, the second cross slide 95 is not affected in thermal deformation of the cross slide 12. Thus, accuracy in positioning and mechanical stiffness of cross slides may be improved.

Although the supporting member 64 is provided to be straightforwardly moved on the grinding head body, the supporting member may be provided to be turned so that it may be retracted from the operating position. Further, the jaw 65 may be formed by a pair of jaws so as to grip the center shaft 61.

From the foregoing, it will be understood that the present invention provides a grinding-wheel spindle assembly in which a grinding wheel is easily attached to and removed from the spindle assembly. Since the spindle assembly is supported at both ends thereof, the structure has a high stiffness, and the influence of thermal deformation is prevented.

While the invention has been described in conjunction with preferred specific embodiments thereof, it will be understood that this description is intended to illustrate and not limit the scope of the invention, which is defined by the following claims.

What is claimed is:

1. A grinding head for a grinding machine comprising:

a grinding head body;

a supporting member movably mounted on said grinding head body;

a jaw provided on said supporting member at an end portion thereof;

a grinding-wheel spindle assembly including a center shaft one end of which is secured to said grinding head body and the other end is supported by said jaw, a sleeve rotatably mounted on said center shaft through hydrostatic bearings, and a grinding wheel secured to said sleeve;

first actuating means for moving said supporting member between an operating position where said center shaft is supported by said jaw and a retracted position apart from said center shaft;

a clamping device for securing said supporting member to said grinding head body;

wheel driving means for rotating said sleeve for grinding operation; and second actuating means for opening and closing said jaw, for removing and attaching the grinding wheel.

2. The grinding head according to claim 1 wherein said clamping device includes a hydraulically operated clamper.

3. The grinding head according to claim 1 wherein said center shaft has an axial oil passage for supplying oil to hydro-static bearings.

4. The grinding head according to claim 1 wherein said supporting member is provided to be straightforwardly moved.

5. The grinding wheel according to claim 1 wherein said grinding head body is vertically slidably mounted on a cross rail of the machine.

6. The grinding head according to claim 1 wherein said first actuating means is a hydraulic cylinder device provided between the supporting member and the grinding head body.

7. The grinding head according to claim 1 wherein said second actuating means is a hydraulic cylinder device.

8. The grinding head according to claim 1 wherein said wheel driving means is a belt and pulley device.

9. The grinding head according to claim 1 further comprising a stopper device for positioning said supporting member at said operating position.

10. The grinding head according to claim 9 further comprising a position sensing device for detecting the position of the supporting member at the operating position.

11. The grinding head according to claim 10 wherein said stopper device is arranged so as to adjust the stopping position.

* * * * *